US006557193B1

(12) United States Patent
Griffith

(10) Patent No.: US 6,557,193 B1
(45) Date of Patent: May 6, 2003

(54) APPARATUS AND METHOD FOR DECORATIVE SKIRTING

(76) Inventor: Delores Jones Griffith, 2283 Old Lee Rd., Lithia Springs, GA (US) 30127

( * ) Notice: Subject to any disclaimer, the term of this patent is extended or adjusted under 35 U.S.C. 154(b) by 0 days.

(21) Appl. No.: 09/718,719

(22) Filed: Nov. 22, 2000

Related U.S. Application Data

(63) Continuation-in-part of application No. 29/110,558, filed on Sep. 9, 1999, now abandoned.

(51) Int. Cl.[7] ..... A47C 21/00
(52) U.S. Cl. ..... 5/493; 5/498
(58) Field of Search ..... 5/493, 498, 658, 5/659, 504.1, 503.1; 24/72.5

(56) References Cited

U.S. PATENT DOCUMENTS 4,141,097 A * 2/1979 Levinsohn et al. ..... 5/493
4,716,608 A * 1/1988 Whitfield ..... 24/72.5
4,860,398 A * 8/1989 Karpinski ..... 24/462

* cited by examiner

*Primary Examiner*—Heather Shackelford
*Assistant Examiner*—Fredrick Conley
(74) *Attorney, Agent, or Firm*—Myers & Kaplan, Intellectual Property Law, L.L.C.; Joel D. Myers

(57) ABSTRACT

A skirting device enabling simple application and retention of accent skirting and a method thereof wherein an adjustably sized, substantially rectangular shaped tubular frame is removably adhered within the upper perimeter of a standard box spring and wherein hook and loop fastener is attached to the frame whereby skirting, also carrying hook and loop fastener, is removably attached thereto, whereby replacement of decorative bed skirting is accomplished without mattress removal.

20 Claims, 3 Drawing Sheets

APPARATUS AND METHOD FOR DECORATIVE SKIRTING

PRIORITY CLAIM

This application is a continuation-in-part application of Ser. No. 29/110,558 filed on Sep. 9, 1999 now ABN, and claims the benefit thereof. Application Ser. No. 29/110,558 was filed under inventor's maiden name of Jones.

TECHNICAL FIELD

The present invention relates generally to decorative linens and, more specifically, to a skirting device enabling simple application and retention of accent skirting and a method thereof. The present invention is particularly useful in, although not strictly limited to, applications desiring placement or removal of decorative bed skirting wherein mattress removal is undesirable.

BACKGROUND OF THE INVENTION

Interest in home fashion trends and decorating continues to grow. Home decor is now the focus of countless books, magazines and television shows. At least one cable network is devoted entirely to such topics. One common theme is the adaptation of expensive ideas for use in everyday households. Another popular topic is the reworking of complicated and time-consuming decorating methods into quick and simple techniques easily handled within the time-constraints of a typical busy schedule.

Many times, refining a process to make it easier, more economical or more time efficient necessitates the introduction of a new product. Some common household chores that have been simplified through product innovation include floor care, made easier with one-step cleaning products, and food preparation, made quicker with all-in-one processing and cooking devices. Decorating concepts, too, have been simplified through product innovation. Some examples include design-textured rollers for quick creation of faux wall finishes and specialty valance forms for easy assembly of decorative window dressings.

The effective use of decorative linens and bedding is an example of a home fashion that is a daily chore. Beautiful bedding ensembles with luxurious pillows and coordinating bed skirts create an elegant room. Unfortunately, most adults find bed making to be drudgery. Daily straightening of sheets, comforters-and pillows is trouble enough, but removal and replacement of bed linens presents an even greater chore.

For example, a traditional bed skirt lies on top of a box spring, underneath a mattress. As such, the entire mattress must be removed before the bed skirt can be taken off for cleaning or replacement. Even with a smaller size twin bed, handling a mattress is cumbersome. For individuals with larger beds, especially king size, it is virtually impossible to accomplish such maneuvering without assistance from at least one individual. The process is time consuming and difficult and the traditional design of a bed skirt is disadvantageous.

Therefore, it is readily apparent that there is a need for a skirting apparatus and home decor method wherein an adjustable frame removably carries decorative skirting and enables quick and easy detachment and replacement thereof, thus preventing the above discussed disadvantages.

BRIEF SUMMARY OF THE INVENTION

Briefly described, in a preferred embodiment, the present invention overcomes the above-mentioned disadvantages, and meets the recognized need for such a device, by providing a skirting device enabling simple application and retention of accent skirting and a method thereof.

According to its major aspects and broadly stated, the present invention is a skirting apparatus and home decor method wherein an adjustable frame removably carries decorative skirting and enables quick and easy detachment and replacement thereof.

More specifically, the present invention is a substantially rectangular shaped, tubular frame device adjustably sized to fit within the upper perimeter of a standard box spring and removably adhered thereto, wherein hook and loop fastener is attached to the frame whereby skirting, also carrying hook and loop fastener, is removably attached thereto. In an alternate embodiment, elastic is sewn or otherwise attached to the perimeter of the skirting as a means for securing the skirting to the frame.

A feature and advantage of the present invention is the ability of such a device to provide an apparatus for retaining decorative skirting that is simple in construction and thus easy to manufacture.

A feature and advantage of the present invention is the ability of such a device to provide a method for quick and easy removal and replacement of decorative skirting.

A feature and advantage of the present invention is the ability of such a device to provide a method for replacement of decorative bed skirting wherein mattress removal is not required.

A feature and advantage of the present invention is the ability of such a device to assist in the decorative display of fabric skirting.

A feature and advantage of the present invention is the ability of such a device to provide a method for quickly interchanging a bed skirt or section thereof.

A feature and advantage of the present invention is the ability of such a device to assist in the free-hanging display of fabric from a box spring or bed having upright bed posters.

These and other objects, features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figure, in which like reference numerals denote similar structure and refer to like elements throughout, and in which.

DETAILED DESCRIPTION OF THE PREFERRED AND ALTERNATE EMBODIMENTS

In describing the preferred and alternate embodiments of the present invention, as illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
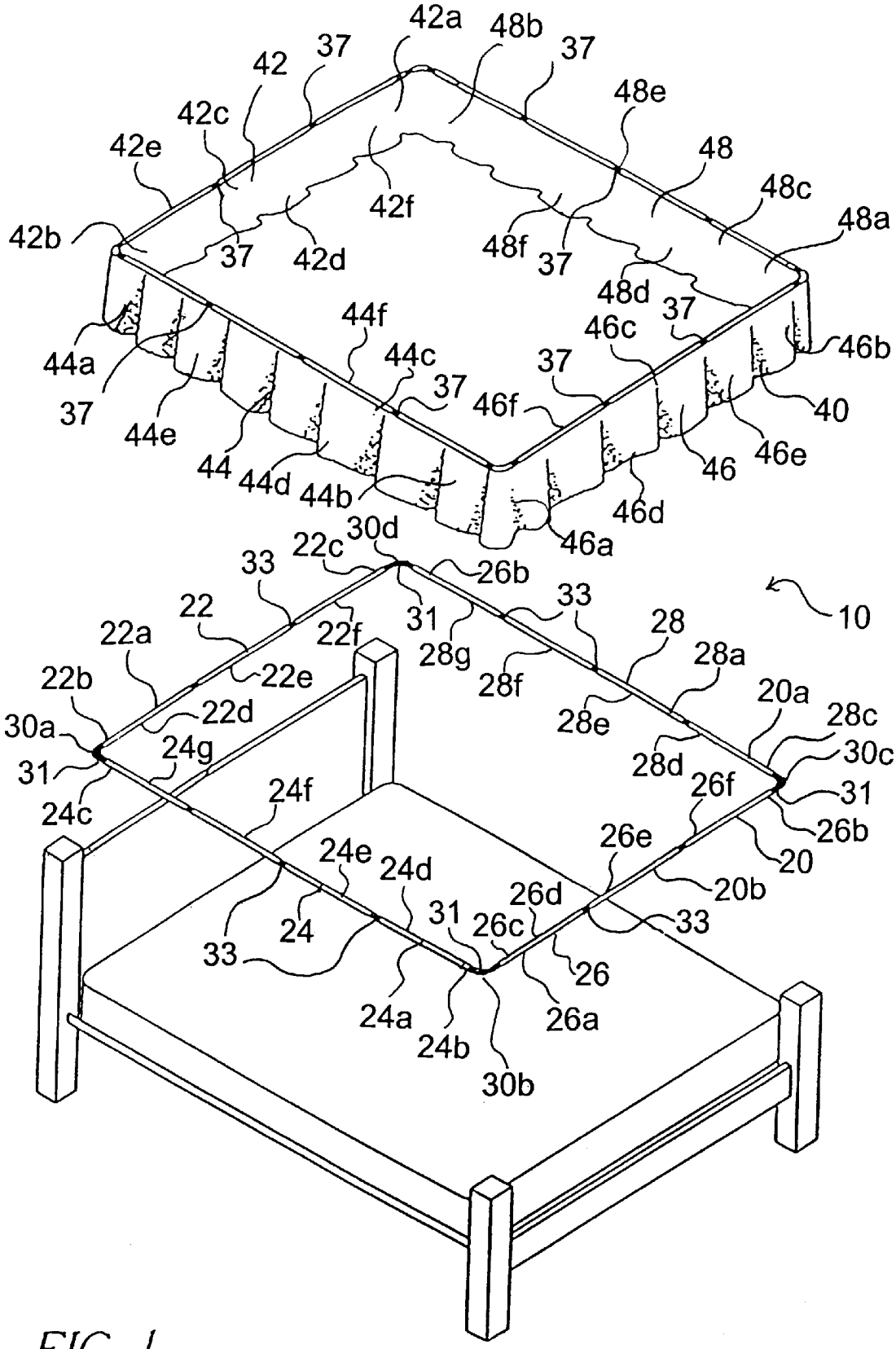
FIG. 1 is an exploded perspective view of a skirting device according to a preferred embodiment of the present invention showing the frame, the skirt and a bed.
Figure 2:
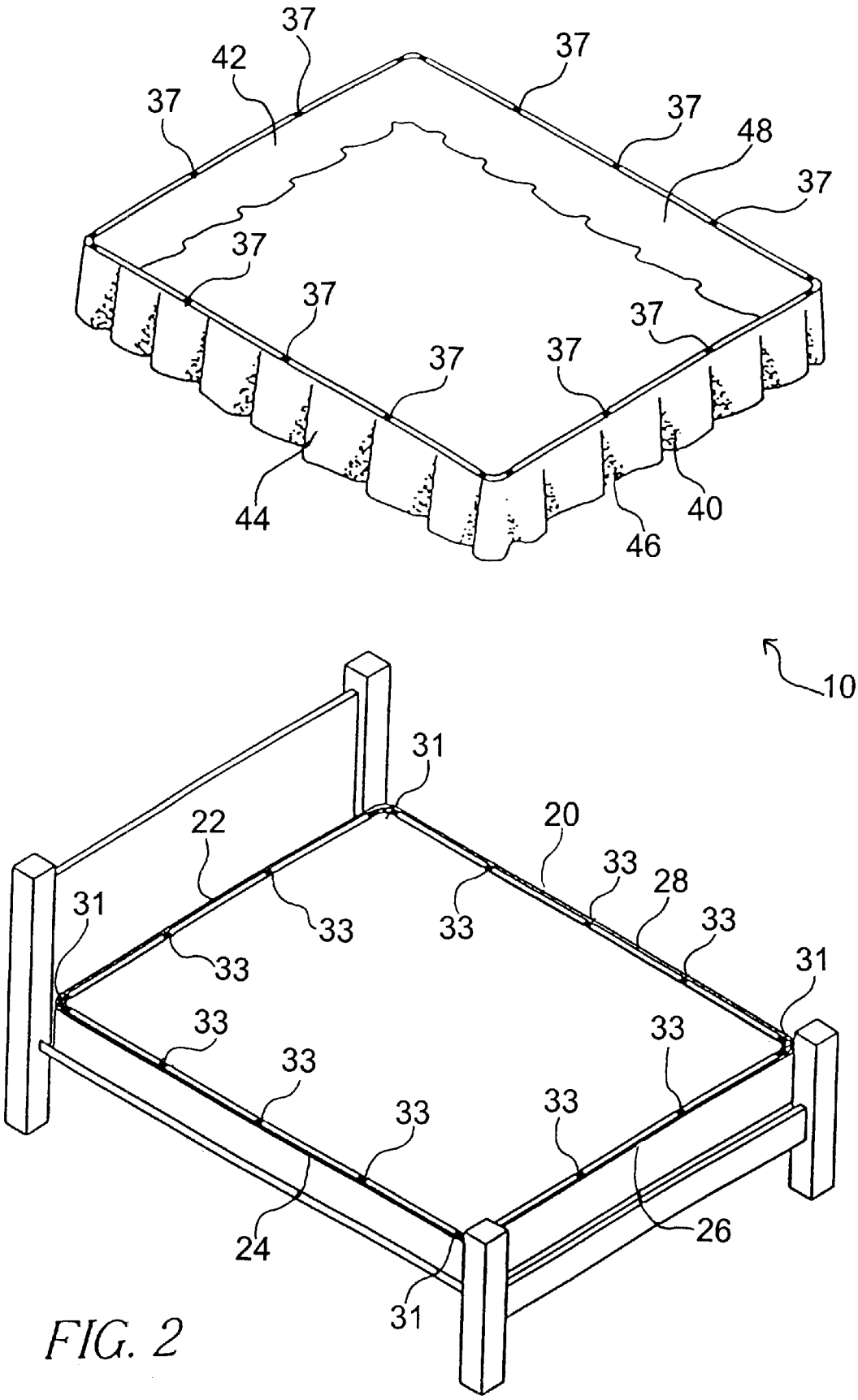
FIG. 2 is a partially exploded perspective view of a skirting device according to a preferred embodiment of the present invention showing the frame resting on a bed and the skirt separated therefrom.
Figure 3:
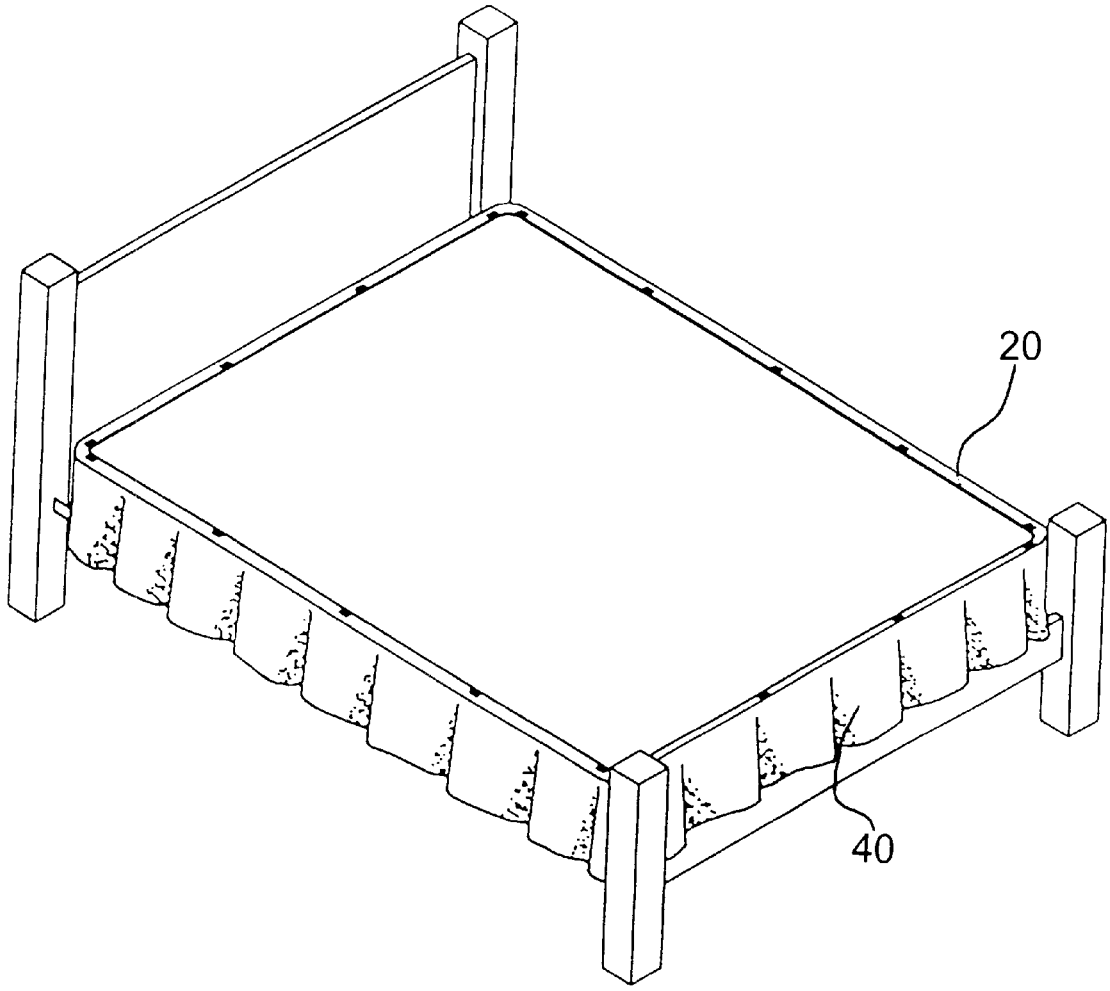
FIG. 3 is a perspective view of a skirting device according to a preferred embodiment of the present invention showing the frame and skirting carried on a bed.

Referring now to FIGS. 1–3, the present invention is a skirting device 10 comprising frame 20 and skirting 40. Frame 20 has upper surface 20*a* and lower surface 20*b*. Preferably, frame 20 is defined by first elongated arm 22, second elongated arm 24, third elongated arm 26 and fourth elongated arm 28. Preferably, arms 22, 24, 26 and 28 are tubular plastic. Preferably, frame 20 is substantially rectangular shaped wherein first elongated arm 22 defines first end 22*a*, second elongated arm 24 defines first side 24*a*, third elongated arm 26 defines second end 26*a* and fourth elongated arm 28 defines second side 28*a*.

Preferably, first elongated arm 22 has first end 22*b*, second end 22*c*, and sub-sections 22*d*, 22*e* and 22*f*. Preferably, second elongated arm 24 has first end 24*b*, second end 24*c*, and subsections 24*d*, 24*e*, 24*f* and 24*g*. Preferably, third elongated arm 26 has first end 26*b*, second end 26*c* and sub-sections 26*d*, 26*e* and 26*f*. Preferably, fourth elongated arm 28 has first end 28*b*, second end 28*c* and sub-sections 28*d*, 28*e*, 28*f* and 28*g*. Frame 20 is preferably dimensioned to fit within the upper perimeter of a standard box spring. Preferably, the overall length of elongated arms 22, 24, 26 and 28 may be varied by the removal of one or more sub-sections 22*d*–22*f*, 24*d*–24*g*, 26*d*–26*f* and 28*d*–28*g*, respectively, thereby providing user-selected size adjustability for multiple uses.

Second end 22*b* of first elongated arm 22 is positioned proximate to second end 26*c* of second elongated arm 24, substantially perpendicular thereto, preferably linked by first corner 30*a*. First end 24*b* of second elongated arm 24 is positioned proximate to second end 26*c* of third elongated arm 26, substantially perpendicular thereto, preferably linked by second corner 30*b*. Preferably, first end 26*b* of third elongated arm 26 is positioned proximate to second end 28*c* of fourth elongated arm 28, substantially perpendicular thereto, preferably linked by third corner 30*c*. Preferably, first end 28*b* of fourth elongated arm 28 is positioned proximate to second end 22*c* of first elongated arm 22, substantially perpendicular thereto, preferably linked by fourth corner 30*d*.

Preferably, corners 30*a*, 30*b*, 30*c* and 30*d* are substantially arcuate shaped tubular plastic, wherein elongated arms 22, 24, 26 and 28 are interconnected thereby. Preferably, two-sided adhesive tape 31 is attached at each corner 30*a*, 30*b*, 30*c* and 30*d* on lower surface 20*b* of frame 20, thereby providing means for removably securing frame 20 to a bed.

Upper surface 20*a* of frame 20 has hook and loop fastener secured thereto. Preferably, each sub-section 22*d*–22*f*, 24*d*–24*g*, 26*d*–26*f* and 28*d*–28*g* of each elongated arm 22, 24, 26 and 28 carries at least one hook and loop fastening means.

Skirting 40 preferably includes first elongated section 42, second elongated section 44, third elongated section 46 and fourth elongated section 48 wherein the length of each skirting section 42, 44, 46 and 48 preferably corresponds to the length each elongated arm 22,. 24, 26 and 28, respectively, of frame 20.

Preferably, elongated skirting section 42 is substantially rectangular shaped fabric having first end 42*a*, second end 42*b*, upper edge 42*c*, lower edge 42*d*, outer surface 42*e* and inner surface 42*f*. Preferably, elongated skirting section 44 is substantially rectangular shaped fabric having first end 44*a*, second end 44*b*, upper edge 44*c*, lower edge 44*d*, outer surface 44*e* and inner surface 44*f*. Preferably, elongated skirting section 46 is substantially rectangular shaped fabric having first end 46*a*, second end 46*b*, upper edge 46*c*, lower edge 46*d*, outer surface 46*e* and inner surface 46*f*. Preferably, elongated skirting section 48 is substantially rectangular shaped fabric having first end 48*a*, second end 48*b*, upper edge 48*c*, lower edge 48*d*, outer surface 48*e* and inner surface 48*f*.

Preferably, each elongated skirting section 42, 44, 46 and 48 has a plurality of hook and loop fastener 37 preferably positioned to correspond with each sub-section 22*c*–22*e*, 24*c*–24*f*, 26*c*–26*e* and 28*c*–28*f* of each elongated arm 22, 24, 26 and 28 wherein hook and loop fastening means is secured to inner surface 42*d*, 44*d*, 46*d* and 48*d*, respectively, proximate to upper edge 42*c*, 44*c*, 46*c* and 48*c*, respectively, wherein skirting 40 is removably attached to frame 20 thereby.

In an alternate embodiment, frame 20 could be manufactured of wood, metal, rubber, foam or other substantially rigid material.

In another alternate embodiment, elongated arms 22, 24, 26 and 28 of frame 20 could be substantially flat.

In yet another alternate embodiment, elongated arms 22, 24, 26 and 28 could link directly with each other, whereby arcuate corners 30*a*, 30*b*, 30*c* and 30*d* would not be provided.

In still another alternate embodiment, elongated arms 22, 24, 26 and 28 could each be formed from one continuous arm, wherein length would not be adjustable.

In yet still another alternate embodiment, hook and loop fastener could be utilized instead of two-sided adhesive tape 31.

In yet another alternate embodiment, frame 20 could be provided without two-sided adhesive tape 31 or other fastening means, wherein frame 20 could be held in place by the weight of a mattress thereon.

In another alternate embodiment, frame 20 and skirting 40 could be provided without hook and loop fastening means thereon whereby skirting 40 could be secured to frame 20 with elastic looping and/or an elastic band that surrounds the perimeter of the skirting.

In still another alternate embodiment, skirting 40 could be one continuous elongated fabric piece defining a substantially rectangular shape.

In yet another alternate embodiment, frame 20 could define an a variety of shapes whereby skirting 40 could be utilized to complement a sofa, chair, daybed, crib, ottoman, chaise, couch or other furniture piece having a cushion or mattress thereon.

In use, skirting device 10 is preferably utilized on a bed whereby a mattress is pushed askew and under side 20*a* of frame 20 is placed against the top surface of a box springs known in the art, wherein the size of frame 20 is adjusted, if necessary, to fit within the upper perimeter thereof. Preferably, pressure is applied to each corner 30*a*, 30*b*, 30*c* and 30*d* whereby adhesive tape 31 removably secures frame 20 to the box springs. Elongated skirting sections 42, 44, 46 and 48 are preferably removably attached to corresponding elongated arms 22, 24, 26 and 28 of frame 20 via hook and loop fastening means. Easy removal and replacement of decorative skirting 40 is accomplished by disassociation of hook and loop fastening means thereof, wherein mattress movement is not required. Skirting sections 42, 44, 46 and 48 may be independently removed and replaced whereby interchanging thereof creates a variety of decorative skirting options.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. Skirting device for positioning between a top surface of a box spring and a bottom surface of a mattress comprising:

a substantially rigid frame having an upper surface and a lower surface, said lower surface positioned proximate to the box spring and said upper surface positioned proximate to the mattress, said frame substantially concealed between the bottom surface of the mattress and the top surface of the box spring;

a fabric component having a top edge and an inner surface; and means carried by said frame for removably attaching said top edge of said fabric component thereto, said attaching means and said top edge of said fabric component concealed between the bottom surface of the mattress and the top surface of the box spring, wherein the weight of the mattress assist said attaching means in securing said top edge of said fabric component thereto.

2. The skirting device of claim 1, wherein said means for removably attaching said fabric component to said frame is a plurality of hook and loop fasteners correspondingly carried by said inner surface of said fabric component proximate to said top edge thereof and said upper surface of said frame.

3. The skirting device of claim 1, wherein said means for removably attaching said fabric component to said frame is a plurality of elasticized loops carried by said fabric component proximate to said top edge thereof.

4. The skirting device of claim 1, wherein said means for removably attaching said fabric component to said frame is a plurality of non-continuous loops carried by said fabric component proximate to said top edge thereof, said loops having a means for closure.

5. The skirting device of claim 4, wherein said means for closure is a hook and loop fastener.

6. The skirting device of claim 4, wherein'said means for closure is a snap.

7. The skirting device of claim 4, wherein said means for closure is a button.

8. The skirting device of claim 1, further comprising means carried by said lower surface of said frame for removably attaching said frame to the substantially flat upper surface of the box spring.

9. The skirting device of claim 8, wherein said means carried by said lower surface of said frame for removably attaching said frame to a substantially flat surface is dual surface adhesive tape.

10. The skirting device of claim 8, wherein said means carried by said lower surface of said frame for removably attaching said frame to a substantially flat surface is a plurality of hook and loop fasteners.

11. The skirting device of claim 1, wherein said substantially rigid frame comprises a plurality of substantially tubular, interconnecting segments.

12. The skirting device of claim 1, wherein said fabric component is elongated.

13. The skirting device of claim 1, wherein said fabric component forms a continuous loop.

14. Portable skirting device for positioning between a bottom surface of a mattress and a top surface of a box spring and for carrying a bedskirt comprising:

a substantially rigid, substantially rectangular-shaped frame having an upper surface, a lower surface and a plurality of substantially tubular, interconnecting segments defining four peripheral walls, each of said peripheral walls having a first end and a second end, wherein said frame is positioned between the top surface of the box spring and the bottom surface of the mattress;

an elongated fabric component having at least four elongated, substantially rectangular shaped segments, a top edge and an inner surface;

means carried by said upper surface of said frame for removably attaching said fabric component to said frame; and means carried by said inner surface of said elongated fabric component proximate to said top edge thereof for removably attaching said fabric component to said frame, wherein said attaching means of said frame and said top edge of said fabric component are concealed between the bottom surface of the mattress and the top surface of the box spring, and wherein the weight of the mattress assist in securing said top edge of said fabric component to said frame.

15. The skirting device of claim 14, wherein said means for removably attaching said fabric component to said frame is a plurality of hook and loop fasteners.

16. The skirting device of claim 14, wherein said means for removably attaching said frame to a box spring is dual surface adhesive tape.

17. The skirting device of claim 14, wherein said plurality of substantially tubular, elongated and interconnecting segments comprises at least four substantially straight segments and four linking segments, wherein at one each of said substantially straight segments define one each of said peripheral walls of said substantially rectangular shaped frame and one each of said linking segments define a corner of said substantially rectangular shaped frame.

18. The skirting device of claim 17, wherein at least two of said substantially straight segments of said frame are telescopically linked, wherein one said segment is slidably positioned within another said segment and wherein the length of at least two said elongated sections of said rectangular shaped frame is adjusted thereby.

19. The method of displaying, retaining and replacing decorative skirting comprising the steps of:

a) obtaining a skirting device having a substantially rigid frame, an elongated fabric portion and means for removably. attaching said fabric portion to said frame;

b) pushing a mattress.off-center exposing a box spring;

c) placing at least one segment of said frame on the box spring, positioning within the upper perimeter thereof;

d) repeating step "b" and step "c" until all said segments of said frame are positioned on said box spring and linked together;

e) re-centering the mattress;

f) attaching said fabric portion to said frame;

g) displaying decorative, hanging skirt;

h) removing said fabric portion from said frame with frame remaining in place;

i) attaching alternative fabric portion to said frame for displaying.

20. A method of installing and displaying a bed skirt comprising the steps of:

a) obtaining a skirting device having a segmented frame, a bed skirt and means for removably attaching said bed skirt to said frame;

b) reaching under a mattress to position at least one segment of said frame;

c) repeating step"b" until all said segments of said frame are positioned under the mattress;

d) reaching under a mattress and attaching said bed skirt to said frame; and e) displaying said bed skirt.

* * * * *